US008360209B2

(12) United States Patent
Roberts

(10) Patent No.: US 8,360,209 B2
(45) Date of Patent: Jan. 29, 2013

(54) DYNAMIC COMPENSATION DURING ELEVATOR CAR RE-LEVELING

(75) Inventor: Randall Keith Roberts, Hebron, CT (US)

(73) Assignee: Otis Elevator Company, Farmington, CT (US)

( * ) Notice: Subject to any disclaimer, the term of this patent is extended or adjusted under 35 U.S.C. 154(b) by 201 days.

(21) Appl. No.: 12/811,217

(22) PCT Filed: Feb. 26, 2008

(86) PCT No.: PCT/US2008/054957

§ 371 (c)(1), (2), (4) Date: Jun. 30, 2010

(87) PCT Pub. No.: WO2009/108186

PCT Pub. Date: Sep. 3, 2009

(65) Prior Publication Data

US 2010/0294598 A1 Nov. 25, 2010

(51) Int. Cl.
*B66B 1/40* (2006.01)

(52) U.S. Cl. ..... 187/291; 187/393

(58) Field of Classification Search ..... 187/289, 187/291, 293, 391–393; 318/757, 758, 460, 318/461, 468, 362, 369
See application file for complete search history.

(56) References Cited

U.S. PATENT DOCUMENTS

| | | | | |
|---|---|---|---|---|
| 3,584,706 | A * | 6/1971 | Hall et al. | 187/289 |
| 3,644,739 | A | 2/1972 | Wilkinson et al. | |
| 3,741,348 | A * | 6/1973 | Caputo | 187/284 |
| 4,503,937 | A | 3/1985 | Cervenec et al. | |
| 4,527,662 | A | 7/1985 | Doane et al. | |
| 4,570,755 | A * | 2/1986 | Tsai et al. | 187/284 |
| 4,785,914 | A * | 11/1988 | Blain et al. | 187/280 |
| 5,880,416 | A | 3/1999 | Colby et al. | |
| 5,959,266 | A | 9/1999 | Uchiumi | |
| 6,089,355 | A * | 7/2000 | Seki et al. | 187/292 |
| 6,202,796 | B1 * | 3/2001 | Lee | 187/293 |
| 6,283,252 | B1 | 9/2001 | Lee | |
| 7,268,514 | B2 * | 9/2007 | DeLange et al. | 318/757 |
| 2005/0230192 | A1 | 10/2005 | Brant | |
| 2011/0233004 | A1 * | 9/2011 | Roberts et al. | 187/247 |

FOREIGN PATENT DOCUMENTS

| | | | |
|---|---|---|---|
| EP | 0429835 | A1 | 6/1991 |
| EP | 0626333 | A1 | 11/1994 |
| JP | 2001122538 | A | 5/2001 |
| KR | 1019920008093 | | 5/1992 |

OTHER PUBLICATIONS

International Preliminary Report on Patentability for International application No. PCT/US2008/054957 mailed Sep. 10, 2010.
International Search Report and Written Opinion of the International Searching Authority for International application No. PCT/US2008/054957 mailed Feb. 20, 2009.

* cited by examiner

*Primary Examiner* — Anthony Salata
(74) *Attorney, Agent, or Firm* — Carlson, Gaskey & Olds PC

(57) ABSTRACT

An exemplary method of controlling elevator car position includes determining that an elevator car required re-leveling. Elevator car dynamics information associated with a current position of the elevator car is determined. A gain for controlling operation of a motor responsible for moving the elevator car for the re-leveling is adjusted based on the determined elevator car dynamics information.

23 Claims, 2 Drawing Sheets

DYNAMIC COMPENSATION DURING ELEVATOR CAR RE-LEVELING

BACKGROUND

Elevator systems include an elevator car that moves between various landings to provide elevator service to different levels within a building, for example. A machine includes a motor and brake for selectively moving the elevator car to a desired position and then maintaining the car in that position. A machine controller controls operation of the machine to respond to passenger requests for elevator service and to maintain the elevator car at a selected landing in a known manner.

One challenge associated with elevator systems is maintaining the car at an appropriate height relative to a landing to facilitate easy passage between the elevator car and a lobby where the elevator car is parked. The car floor is ideally kept level with the landing floor to make it easy for passengers to move between the lobby and the elevator car while minimizing the possibility of someone tripping. Current elevator codes define a displacement threshold that establishes a maximum difference that is allowable between the landing floor and the elevator car floor. When that distance is above the code threshold, the elevator system must re-level or correct the position of the elevator car.

The conventional elevator re-leveling approach includes sensing the amount of car-to-floor displacement. This is typically accomplished using an encoder on the primary position transducer or governor associated with the elevator car. When the displacement exceeds a set threshold, a re-leveling process begins. The machine controller makes a determination regarding the weight of the car and pre-torques the motor for lifting the car before releasing the machine brake. The motor current is then controlled using an inner velocity servo loop that has an outer position loop using a fixed gain feedback compensator (such as a Proportional plus Integral control) on the position error.

The conventional approach to re-leveling an elevator car works well in most situations. In high rise buildings and ultra high rise buildings, the conventional approach may not provide satisfactory results. This occurs, in part, because the effective stiffness of elevator roping members decreases proportionally with their length. Accordingly, a longer elevator roping arrangement allows for increased amounts of static deflection responsive to changing loads on the elevator car, which results from passengers entering or exiting the car, for example. Additionally, there is time delay between motor action, car reaction and position transducer response that increases linearly with the height of the hoistway. Such a delay introduces potential stability issues in the position feedback logic associated with the conventional approach. Another issue is that the reduced stiffness of the roping arrangement reduces the resonant frequency associated with elevator car bounce resulting from changes in the load on the car. The lower frequency resonance creates a limitation on traditional control logic gains, which limits bandwidth and, therefore, performance.

SUMMARY

An exemplary method of controlling elevator car position includes determining that an elevator car requires re-leveling. Elevator car dynamics information associated with a current position of the elevator car is determined. A gain for controlling operation of a motor responsible for moving the elevator car for the re-leveling is adjusted based on the determined elevator car dynamics information.

An exemplary elevator system comprises a device for controlling an elevator motor that includes a velocity servo having a gain with a set value. A dynamic compensation module selectively adjusts the gain of the velocity servo from the set value based on elevator car dynamics information associated with a current position of an elevator car.

The various features and advantages of this invention will become apparent to those skilled in the art from the following detailed description. The drawings that accompany the detailed description can be briefly described as follows.

DETAILED DESCRIPTION

Figure 1:
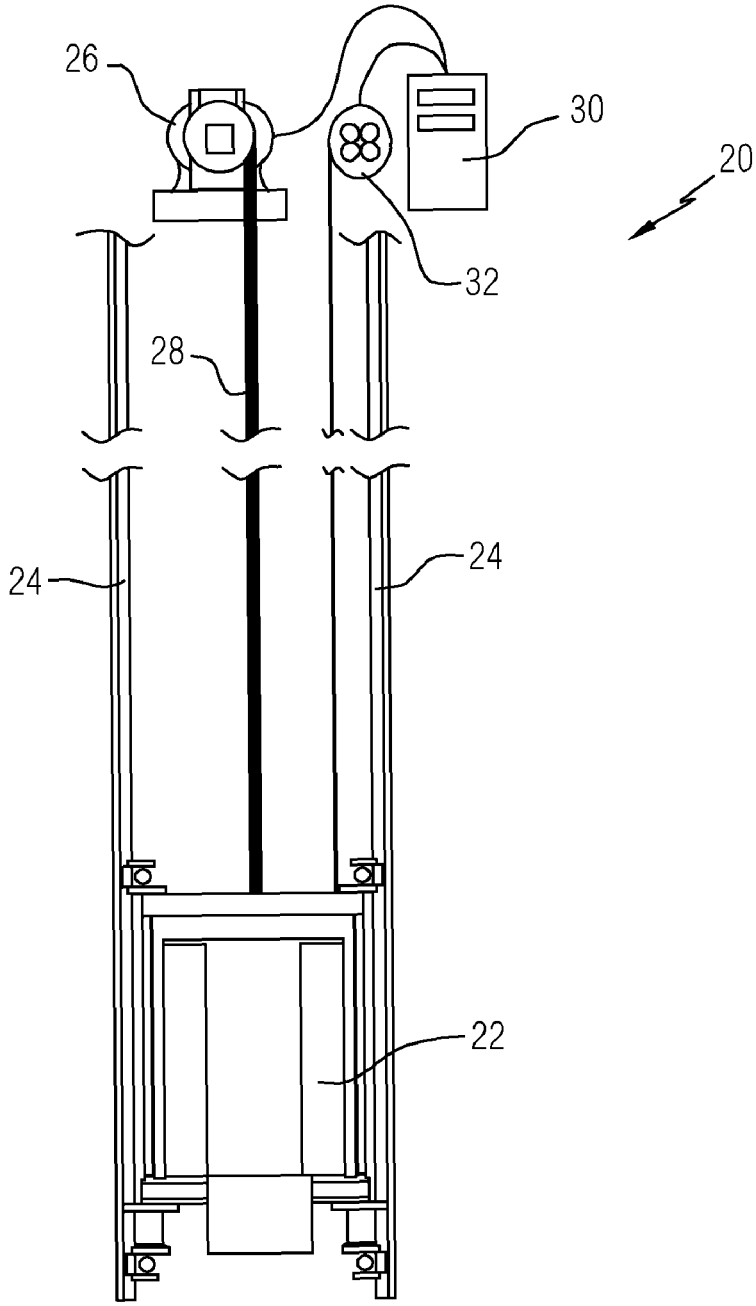
FIG. 1 schematically shows selected portions of an example elevator system.

FIG. 1 schematically illustrates selected portions of an example elevator system 20. An elevator car 22 is supported for movement along guide rails 24 responsive to operation of an elevator machine 26. In this example, the elevator machine 26 is responsible for controlling movement of a roping arrangement 28 that supports the weight of the elevator car 22. A motor and brake of the machine 26 operate responsive to an elevator machine controller 30 to achieve the desired movement and positioning of the elevator car 22.

The controller 30 utilizes information regarding operation of the machine 26 and information regarding a position of the elevator car 22 for determining how to control the machine 26 to achieve desired elevator system operation. The example of FIG. 1 includes a primary position transducer 32 that provides information to the controller 30 regarding the position of the elevator car 22. For example, the primary position transducer 32 comprises an encoder wheel and a rope or tape that moves with the elevator car 22 such that the encoder wheel provides information to the controller 30 that indicates a current position of the elevator car. The information regarding the position of the elevator car 22 can be determined in any known manner.

The controller 30 includes a velocity servo that is used for controlling operation of the motor of the machine 26. The velocity servo has proportional ($K_p$) and integral ($K_i$) gains that control the motor torque signals provided to the motor of the machine 26. The velocity servo gains are set in a known manner to provide desired elevator system performance.

Under some circumstances, it will be necessary to re-level the elevator car 22 when it is stopped at a landing. In the case of a high rise or ultra-high rise building, when the elevator car 22 is at a relatively low landing, the extended length of the roping arrangement 28 introduces additional control challenges as described above. The example controller 30 utilizes an adjusted velocity servo gain to achieve a desired re-leveling performance when the elevator car 22 is at a landing where conventional re-leveling techniques alone may not provide the desired results.

Figure 2:
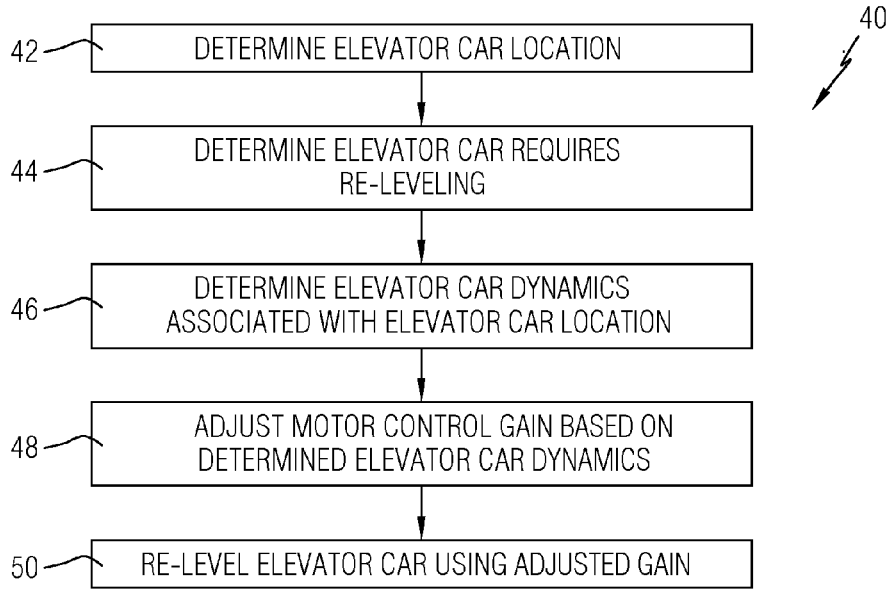
FIG. 2 is a flowchart diagram summarizing one example approach.

FIG. 2 includes a flowchart diagram 40 that summarizes one example approach. The elevator car position or location is determined at 42. At 44, a determination is made that the elevator car requires re-leveling. This may occur during load changes at a landing, for example. At 46, a determination is made regarding elevator car dynamics information associated with the elevator car location. For example, when the elevator car 22 is at a relatively low landing in a high rise or ultra-high rise building, there will be elevator car dynamics that affect an attempt at re-leveling the elevator car. The determination at 46 in one example includes determining whether the elevator car is at a landing where such elevator dynamics information is important. One example includes empirically determining such information as a part of the elevator system design or installation process so that the controller 30 is provided with such information stored in memory, for example. One example includes a look up table having elevator car dynamic information associated with corresponding elevator car positions so that the controller 30 may look up such information based upon the determined elevator car location.

In situations where elevator car dynamics information will be useful for re-leveling control, the motor control gain is adjusted at 48 based upon the determined elevator car dynamics information. At 50, the elevator car is re-leveled using the adjusted gain.

In situations where the elevator car dynamics information is not necessary for controlling the motor of the machine 26, the set or default gain of the motor control is used without adjustment. The set or default gain value is useful during normal elevator motion and re-leveling procedures at relatively higher building levels, for example.

Figure 3:
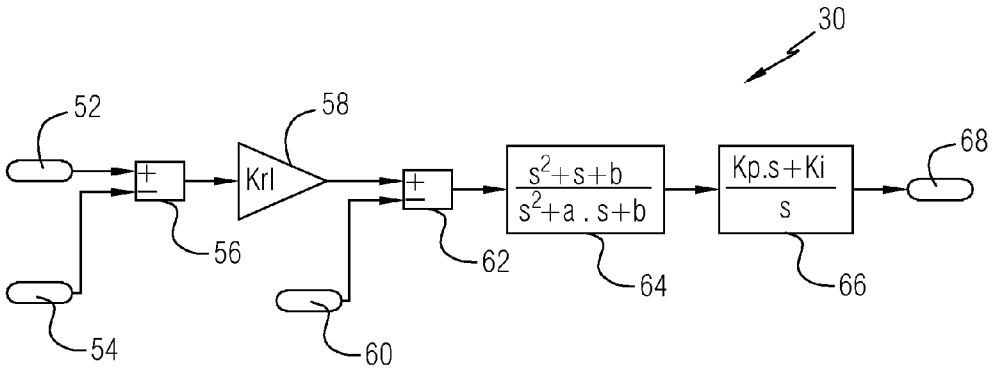
FIG. 3 schematically illustrates an example elevator control arrangement.

FIG. 3 schematically illustrates an example elevator control configuration where a portion of the controller 30 is schematically represented. In this example, conventional elevator motor control techniques are used for providing control signals to operate the motor of the machine 26 under most elevator system operating conditions. When re-leveling is required and the elevator car is at a location where the elevator car dynamics will have an effect on the re-leveling, the gain associated with the motor control is adjusted to provide desired re-leveling performance.

In FIG. 3, a desired elevator car position input 52 is compared with an actual elevator car position indication 54 using a comparator 56. The output of the comparator 56 (i.e., any difference between the actual and desired positions of the elevator car) is processed by a re-leveling gain module 58. In one example, the re-leveling gain is a fixed value. The output of the re-leveling gain module 58 is compared with a primary velocity transducer input 60 in a comparator 62.

The output of the comparator 62 is provided to a dynamic compensation module 64 that provides an adjustment for adjusting the gain of a velocity servo 66. The dynamic compensation module 64 in this example comprises a second order notch filter that utilizes two parameters that are indicative of the dynamic response of the elevator car. The two parameters in one example comprise a resonant frequency of a bounce mode of the elevator car and an attenuation factor. These two parameters are based on characteristics of the roping arrangement 28 in one example. In FIG. 3, "b" represents the frequency of the bounce mode squared and "a" represents the attenuation factor. In this example, a and b are the elevator car dynamic information that is utilized for adjusting the gain of the velocity servo 66. In FIG. 3, s indicates a Laplace operator.

The velocity servo gains ($K_p$ and $K_i$) are increased and provide improved performance during re-leveling of the elevator car 22. The velocity servo 66 provides a motor torque signal output 68 that is used for controlling the motor of the machine 26 during re-leveling.

If the velocity servo gain were increased without taking into account the elevator car dynamic information, it would be possible to excite the resonant frequency of the elevator roping arrangement 28, for example, which would introduce vibration or bouncing of the elevator car. Utilizing the elevator car dynamics information for adjusting the velocity servo gain allows for increasing the gain to provide improved re-leveling performance while avoiding exciting the hoistway components such as the roping arrangement 28 at the resonant frequency of the bounce mode associated with the extended length of the roping arrangement 28, for example. The adjustment of the velocity servo gain provided by the dynamic compensation module 64 effectively minimizes the excitation of the elevator vertical vibration mode while still allowing for higher velocity servo gains to be realized.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

I claim:

1. A method of controlling elevator car position, comprising:

determining that an elevator car requires re-leveling;

determining elevator car dynamics information associated with a current position of the elevator car; and adjusting a gain for controlling operation of a motor responsible for moving the elevator car to accomplish the re-leveling while the elevator car is stopped at a landing based on the determined elevator car dynamics information.

2. The method of claim 1, comprising generating a motor torque signal for controlling the motor for moving the elevator car to accomplish the required re-leveling using the adjusted gain.

3. The method of claim 1, comprising using the adjusted gain when moving the elevator car during re-leveling; and using a different, default gain during other elevator operation conditions.

4. The method of claim 1, comprising determining elevator car dynamics information corresponding to each of a plurality of elevator car positions;

storing the determined elevator car dynamics information in association with an indication of the corresponding elevator car positions; and determining the elevator car dynamics information by selecting the stored information associated with the current position of the elevator car.

5. The method of claim 1, wherein the gain has a default value and adjusting the gain comprises increasing the gain above the default value.

6. The method of claim 1, wherein the gain is a proportional integral gain of a velocity servo associated with the motor.

7. The method of claim 1, wherein the elevator car dynamics information comprises information regarding dynamics of a roping arrangement used to support the elevator car.

8. The method of claim 1, wherein the elevator car dynamics information comprises at least a first parameter indicative of a frequency of a bounce mode of the elevator car and a second parameter indicative of an attenuation factor.

9. The method of claim 8, wherein the first parameter comprises the frequency squared.

10. The method of claim 1, comprising using the determined elevator car dynamics information in a second order notch filter to obtain an adjustment factor for the adjusting.

11. An elevator system, comprising:

a device for controlling an elevator motor including a velocity servo having a gain with a set value; and a dynamic compensation module that selectively adjusts the gain of the velocity servo from the set value for controlling operation of the elevator motor for moving an elevator car to re-level the elevator car while the elevator car is stopped at a landing based on elevator car dynamics information associated with a current position of an elevator car.

12. The elevator system of claim 11, wherein the dynamic compensation module increases the gain above the set value.

13. The elevator system of claim 12, comprising an electronic storage of predetermined elevator car dynamics information associated with each of a plurality of elevator car positions and wherein the dynamic compensation module determines the elevator car dynamics information from the storage based on a current position of the elevator car.

14. The elevator system of claim 11, wherein the velocity servo generates a motor torque signal using the adjusted gain.

15. The elevator system of claim 14, wherein the velocity servo generates the motor torque signal using the adjusted gain for re-leveling an elevator car and otherwise uses the set value of the gain.

16. The elevator system of claim 11, wherein the gain is a proportional integral gain of the velocity servo.

17. The elevator system of claim 11, wherein the elevator car dynamics information comprises information regarding dynamics of a roping arrangement used to support the elevator car.

18. The elevator system of claim 11, wherein the elevator car dynamics information comprises at least a first parameter indicative of a frequency of a bounce mode of the elevator car and a second parameter indicative of an attenuation factor.

19. The elevator system of claim 18, wherein the first parameter comprises the frequency squared.

20. The elevator system of claim 11, wherein the dynamic compensation module comprises a second order notch filter that provides an adjustment factor for adjusting the gain.

21. The elevator system of claim 11, comprising:

an elevator car;

a roping arrangement secured to the elevator car;

a motor for moving the roping arrangement to cause movement of the elevator car; and a motor controller for controlling the motor, the motor controller comprising the device.

22. A method of controlling elevator car position, comprising:

determining that an elevator car requires re-leveling;

determining elevator car dynamics information associated with a current position of the elevator car; and adjusting a gain for controlling operation of a motor responsible for moving the elevator car for the re-leveling based on the determined elevator car dynamics information, wherein the elevator car dynamics information comprises at least a first parameter indicative of a frequency of a bounce mode of the elevator car and a second parameter indicative of an attenuation factor.

23. An elevator system, comprising:

a device for controlling an elevator motor including a velocity servo having a gain with a set value; and a dynamic compensation module that selectively adjusts the gain of the velocity servo from the set value based on elevator car dynamics information associated with a current position of an elevator car, wherein the elevator car dynamics information comprises at least a first parameter indicative of a frequency of a bounce mode of the elevator car and a second parameter indicative of an attenuation factor.

* * * * *